US006494176B2

(12) United States Patent
Ito et al.

(10) Patent No.: US 6,494,176 B2
(45) Date of Patent: Dec. 17, 2002

(54) OIL MIST GENERATION SYSTEM IN HANDHELD TYPE FOUR-CYCLE ENGINE

(75) Inventors: Keita Ito, Wako (JP); Takao Nishida, Wako (JP); Sei Watanabe, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/808,405

(22) Filed: Mar. 15, 2001

(65) Prior Publication Data

US 2001/0035148 A1 Nov. 1, 2001

(30) Foreign Application Priority Data

Mar. 21, 2000 (JP) ..... 2000-083257

(51) Int. Cl.[7] ..... F01M 1/00
(52) U.S. Cl. ..... 123/196 R
(58) Field of Search ..... 123/196 R, 196 W, 123/196 M; 184/11.1, 15.1

(56) References Cited

FOREIGN PATENT DOCUMENTS

JP 405018223 A * 1/1993 ..... F01M/9/06
JP 11-326012 11/1999

* cited by examiner

*Primary Examiner*—Willis R. Wolfe
*Assistant Examiner*—Rebecca A Smith
(74) *Attorney, Agent, or Firm*—Armstrong, Westrman & Hattori, LLP

(57) ABSTRACT

In an oil mist generation system, an oil slinger is disposed in an oil tank and is rotated by a crankshaft, the oil slinger scattering oil store in the oil tank by the rotation of the oil slinger so as to generate an oil mist. The oil mist generation system includes a drive gear provided on the crankshaft, and at least three oil slingers supported on three support shafts and simultaneously driven by the drive gear, the three support shafts being arranged around the drive gear. Therefore, besides a circular shape, various shapes can be imparted to the peripheral wall of the oil tank.

1 Claim, 8 Drawing Sheets

OIL MIST GENERATION SYSTEM IN HANDHELD TYPE FOUR-CYCLE ENGINE

BACKGROUND OF THE INVENTION

1. Field of the Invention

The present invention relates to a system for generating an oil mist for lubricating the internal parts of a handheld type four-cycle engine which is used mainly as a power source for portable working apparatus such as a trimmer. In particular, it relates to an improvement of a system in which an oil slinger rotated by a crankshaft is provided inside an oil tank provided on one side of an engine main body, and an oil mist is generated by scattering the oil stored inside the oil tank by rotation of the oil slinger.

2. Description of the Related Art

An oil mist generation system which is already known, for example, in Japanese Patent Application Laid-open No. 11-326012, which discloses a single oil slinger having a plurality of vanes, the forward end of the vanes being bent, is fixed to the crankshaft of an engine so that the oil stored in the oil tank can always be scattered by rotation of the above-mentioned vanes regardless of the operational position of the engine.

However, since only one oil slinger is rotated in the above-mentioned conventional system, a peripheral wall of the oil tank housing the oil slinger is inevitably limited to a circular shape, the degrees of freedom in choosing the shape of the oil tank is extremely low and the layout of the equipment adjoining the oil tank is highly restricted.

SUMMARY OF THE INVENTION

The present invention has been carried out in view of the above-mentioned circumstances. It is an object of the present invention to provide an oil mist generation system for use in the above-mentioned handheld type four-cycle engines. The system allows the shape of the peripheral wall of the oil tank to be in various shapes besides a circular shape.

In accordance with a first aspect of the present invention in order to achieve the above-mentioned object, there is proposed an oil mist generation system in a handheld type four-cycle engine including an oil slinger which is provided in an oil tank disposed on one side of an engine main body and which is rotated by a crankshaft, the oil slinger scattering oil stored in the oil tank by the rotation by of the oil slinger so as to generate an oil mist, wherein the oil mist generation system includes a drive gear provided on the crankshaft, and at least three oil slingers supported on three support shafts and simultaneously driven by the drive gear, the three support shafts being arranged around the drive gear.

In accordance with the above-mentioned first aspect, it is possible to freely change the shape of the peripheral wall of the oil tank surrounding the oil slingers by selecting the positions around the drive gear of the three support shafts supporting each of the oil slingers, and the degrees of freedom in the layout of the equipment adjoining the oil tank thus increase.

In accordance with a second aspect of the present invention, in addition to the above-mentioned characteristic, there is proposed an oil mist generation system in a handheld type four-cycle engine wherein a rotating member of a valve operation mechanism functions as part of the oil slingers.

The above-mentioned rotating member corresponds to the cam gears 36, 136 and 137 in the embodiments of the present invention below.

In accordance with the above-mentioned second aspect, since the rotating member of the valve operation mechanism functions as part of the oil slingers, the number of special oil slingers can be reduced and the structure of the oil mist generation system can thus be simplified.

The above-mentioned object, other objects, characteristics and advantages of the present invention will become apparent from an explanation of preferable embodiments which will be described in detail below by reference to the attached drawings.

BRIEF DESCRIPTION OF THE DRAWINGS

FIG. 1 is an perspective view showing one embodiment of the handheld type four-cycle engine of the present invention in practical use.

FIG. 2 is a vertically sectioned front view of the above-mentioned four-cycle engine.

FIG. 3 is a cross-sectional view at line 3—3 in FIG. 2.

FIG. 4 is a cross-sectional view at line 4—4 in FIG. 2.

DESCRIPTION OF PREFERRED EMBODIMENTS

The first embodiment of the present invention shown in FIGS. 1 to 4 is explained first.

Figure 1:
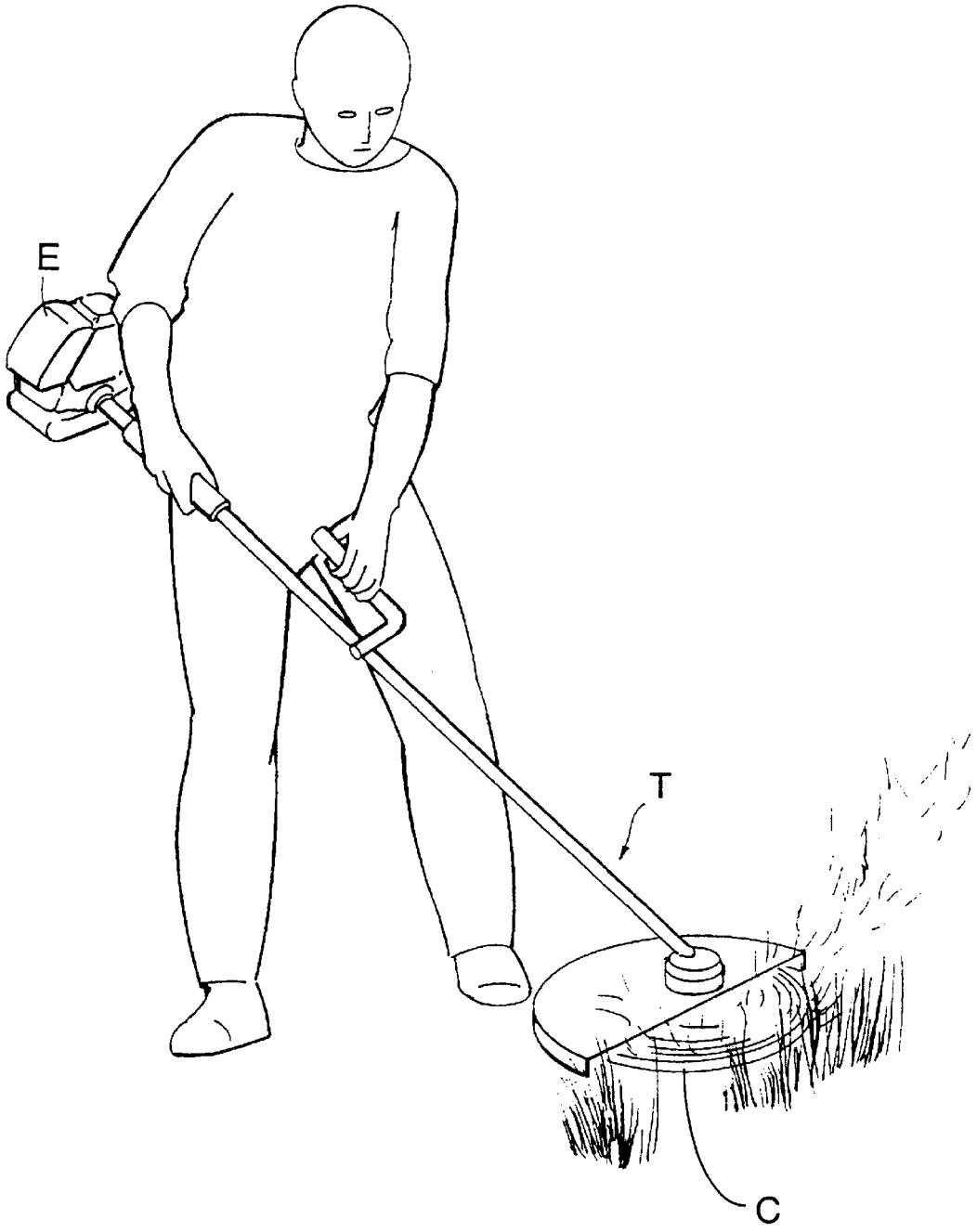
FIGS. 1 to 4 illustrate a first embodiment of the present invention.

As shown in FIG. 1, a handheld type four-cycle engine E to which the present invention is applied is fitted as the source of power to the drive section of, for example, a powered trimmer T. Since the powered trimmer T is used in a manner in which a cutter C is positioned in various directions according to the operational conditions, the engine E is also tilted to a large extent or turned upside-down as a result and the operational position is unstable.

Figure 2:
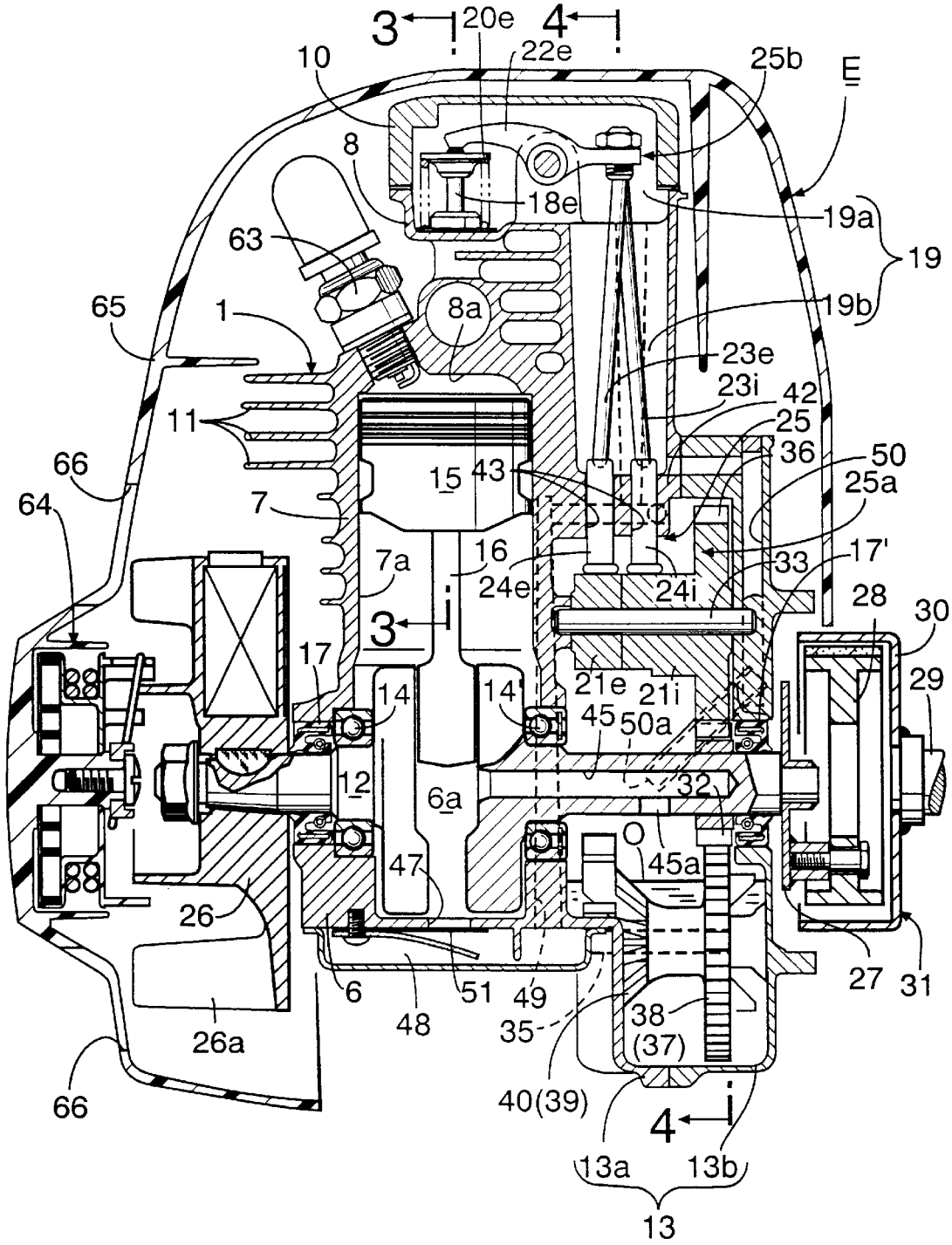
Figure 3:
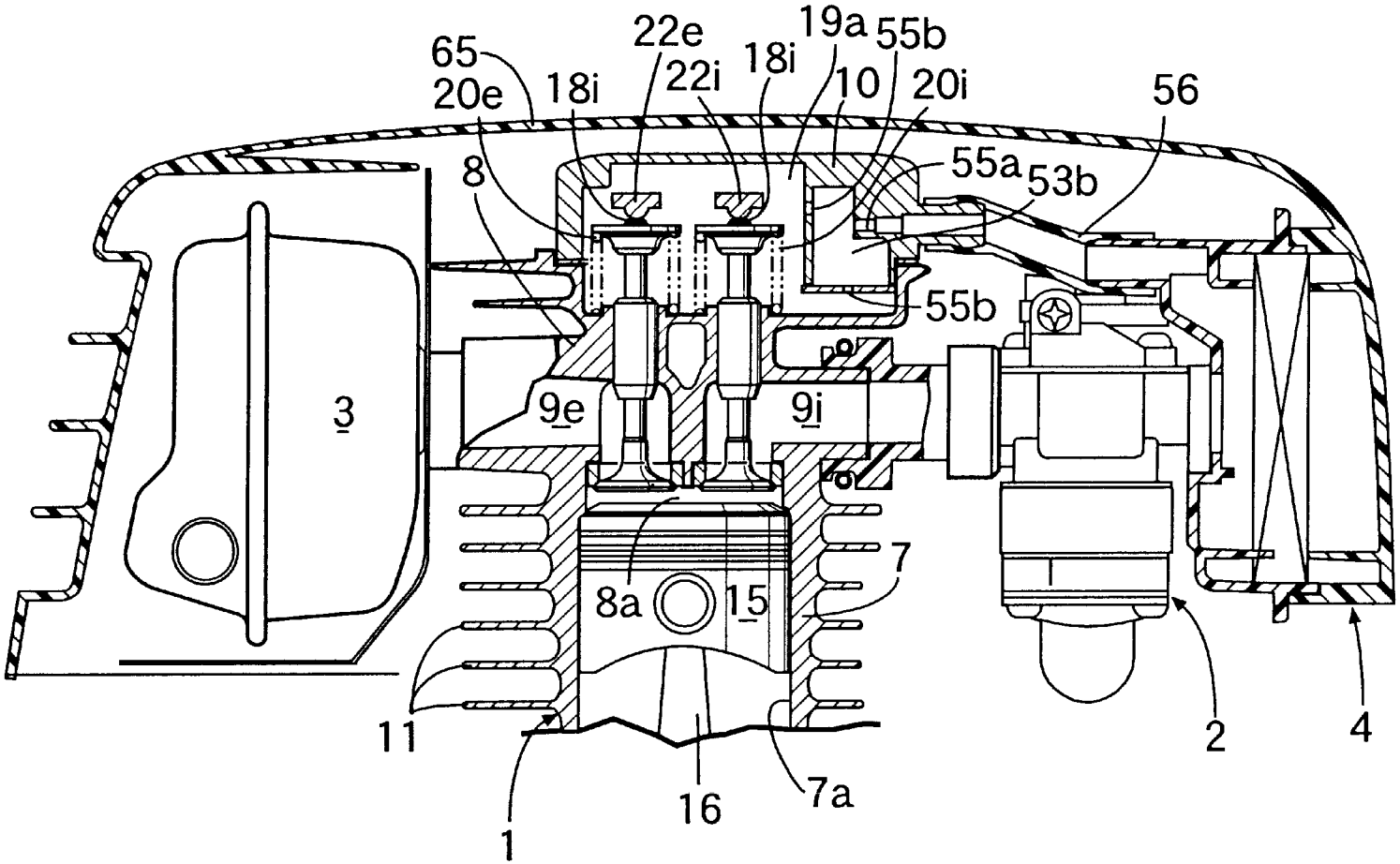

As shown in FIGS. 2 and 3, the engine main body 1 of the above-mentioned handheld type four-cycle engine E includes a crankcase 6 having a crank chamber 6*a*, a cylinder block 7 having one cylinder bore 7*a*, and a cylinder head 8 having a combustion chamber 8*a*, a large number of cooling fins 11 being formed on the outer peripheries of the cylinder block 7 and the cylinder head 8.

A crankshaft 12 housed in the crank chamber 6*a* is rotatably supported in left and right side walls of the crankcase 6 via ball bearings 14 and 14' and is also connected to a piston 15 fitted in the cylinder bore 7*a* via a connecting rod 16. An oil seal 17 is fitted in the left-hand side wall of the crankcase 6 so as to adjoin the outside of the bearing 14, a flywheel 26 having a large number of cooling vanes 26*a* is fixed to the left-hand end of the crankshaft 12 running through the oil seal 17 and projecting out of the crankcase 6, the flywheel 26 functioning also as a cooling fan, and a recoil type starter 64 is positioned outside the flywheel 26.

An oil tank 13 is provided so as to be connected to the right-hand side wall running the length of the crankcase 6 and the cylinder block 7. A fuel tank 5 is provided on one side of the oil tank 13 and beneath a carburettor 2 and an air cleaner 4 which will be described below.

The oil tank 13 includes a tank inner half 13*a* and a tank outer half 13*b*, the tank inner half 13*a* being integrally provided over the crankcase 6 and the cylinder block 7, and the tank outer half 13*b* being bolt-joined to the tank inner half 13*a*. The right-hand end of the crankshaft 12 runs through and projects out of the oil tank 13. An oil seal 17' in close contact with the outer circumference of the crankshaft 12 is fitted in the tank outer half 13*b*.

A drive plate 27 is fixed to the right-hand end of the crankshaft 12 projecting out of the oil tank 13, and a plurality of centrifugal shoes 28 (one thereof is shown in the figure) are pivotally supported on the drive plate 27 in a rockable manner. These centrifugal shoes 28, together with a clutch drum 30 connected to a drive shaft 29 for driving the aforementioned cutter C, form a centrifugal clutch 31 and when the rotational rate of the crankshaft 12 exceeds a predetermined value, the centrifugal shoes 28 are pressed onto the inner periphery of the clutch drum 30 due to the centrifugal force of the shoes so transmitting the output torque of the crankshaft 12 to the drive shaft 29.

An engine cover 65 is fixed to the engine main body 1 so as to cover it, a recoil type starter 64 is supported in the cover 65, and an air inlet 66 is provided in the engine cover 65 around the recoil type starter 64 so as to face the cooling vanes 26*a* of the flywheel 26.

An intake port 9*i* and an exhaust port 9*e* opening into the combustion chamber 8*a* are formed in the cylinder head 8, and the cylinder head 8 is also provided with an intake valve 18*i* and an exhaust valve 18*e* and an ignition plug 63, the intake valve 18*i* and the exhaust valve 18*e* opening and closing the intake port 9*i* and the exhaust port 9*e*, and the electrodes of the ignition plug 63 extending into the combustion chamber 8*a*.

A rocker chamber 19*a* whose upper face is blocked by a head cover 10 is provided in the cylinder head 8, a pushrod chamber 19*b* extending from one side of the rocker chamber 19*a* down to the top of the oil tank 13 is formed in one side wall of the cylinder block 7, and the rocker chamber 19*a* and the pushrod chamber 19*b* together form a valve operation chamber 19. A valve operation mechanism 25 for closing and opening the intake and exhaust valves 18*i* and 18*e* is provided running through the valve operation chamber 19 and the oil tank 13.

That is to say, the valve operation mechanism 25 includes a rotational movement section 25*a* housed in the oil tank 13 and a reciprocating movement section 25*b* housed in the valve operation chamber 19. The rotational movement section 25*a* includes a drive gear 32 fixed to the crankshaft 12, a cam gear 36 rotatably supported on a support shaft 33 and meshed with the drive gear 32, the two ends of the support shaft 33 being supported in the oil tank 13, and an intake cam 21*i* and an exhaust cam 21*e* formed integrally with the cam gear 36, and the cam gear 36 is driven by the drive gear 32 at a reduction rate of ½. The drive gear 32 and the cam gear 36 are positioned above the crankshaft 12 and close to the outside wall of the oil tank 13.

The reciprocating movement section 25*b* includes valve springs 20*i* and 20*e* forcing the intake and exhaust valves 18*i* and 18*e* respectively in the closed direction, rocker arms 22*i* and 22*e* supported in a rockable manner in the cylinder head 8, one end of each of the rocker arms 22*i* and 22*e* being in contact with the corresponding upper ends of the intake and exhaust valves 18*i* and 18*e*, and pushrods 23*i* and 23*e* (see FIG. 4), the upper end of each of the pushrods 23*i* and 23*e* being in contact with the corresponding other ends of the rocker arms 22*i* and 22*e*. The rocker arms 22*i* and 22*e* are housed in the rocker chamber 19*a*, and the pushrods 23*i* and 23*e* are housed in the pushrod chamber 19*b*. Tappets 24*i* and 24*e* receiving the lower end of each of the pushrods 23*i* and 23*e* and engaging with the intake and exhaust cams 21*i* and 21*e* respectively are fitted in a sliceable manner in guide holes 43 and 43 in a partition wall 42 between the pushrod chamber 19*b* and the oil tank 13.

The engine E is thus constructed as an OHV type.

When the intake and exhaust cams 21*i* and 21*e* are rotated by the crankshaft 12 via the drive gear 32 and the cam gear 36, these cams 21*i* and 21*e* work together with the valve springs 20*i* and 20*e*, and allow the corresponding pushrods 23*i* and 23*e* to ascend and descend alternately so as to rock the rocker arms 22*i* and 22*e*, and the intake and exhaust valves 18*i* and 18*e* are thus opened and closed alternately with appropriate timing.

As shown in FIG. 3, the intake port 9*i* is connected to a carburettor 2 and an air cleaner 4 in that order, and the exhaust port 9*e* is connected to an exhaust muffler 3. The carburettor 2 and the exhaust muffler 3 are placed along a direction perpendicular to the axes of both the crankshaft 12 and the cylinder bore 7*a*.

The lubrication system of the engine E is explained below by reference to FIGS. 2 and 4.

An end of each of two support shafts 34 and 35 arranged around and beneath the crankshaft 12 is supported in the oil tank 13, and toothed oil slingers 37 and 38 meshed with the above-mentioned drive gear 32 are rotatably supported on the support shafts 34 and 35. These toothed oil slingers 37 and 38 are positioned close to the outside wall of the oil tank 13 in the same way as the cam gear 36, and vane type oil slingers 39 and 40 positioned close to the inside wall of the oil tank 13 are joined integrally to the corresponding toothed oil slingers 37 and 38 via bosses.

Figure 4:
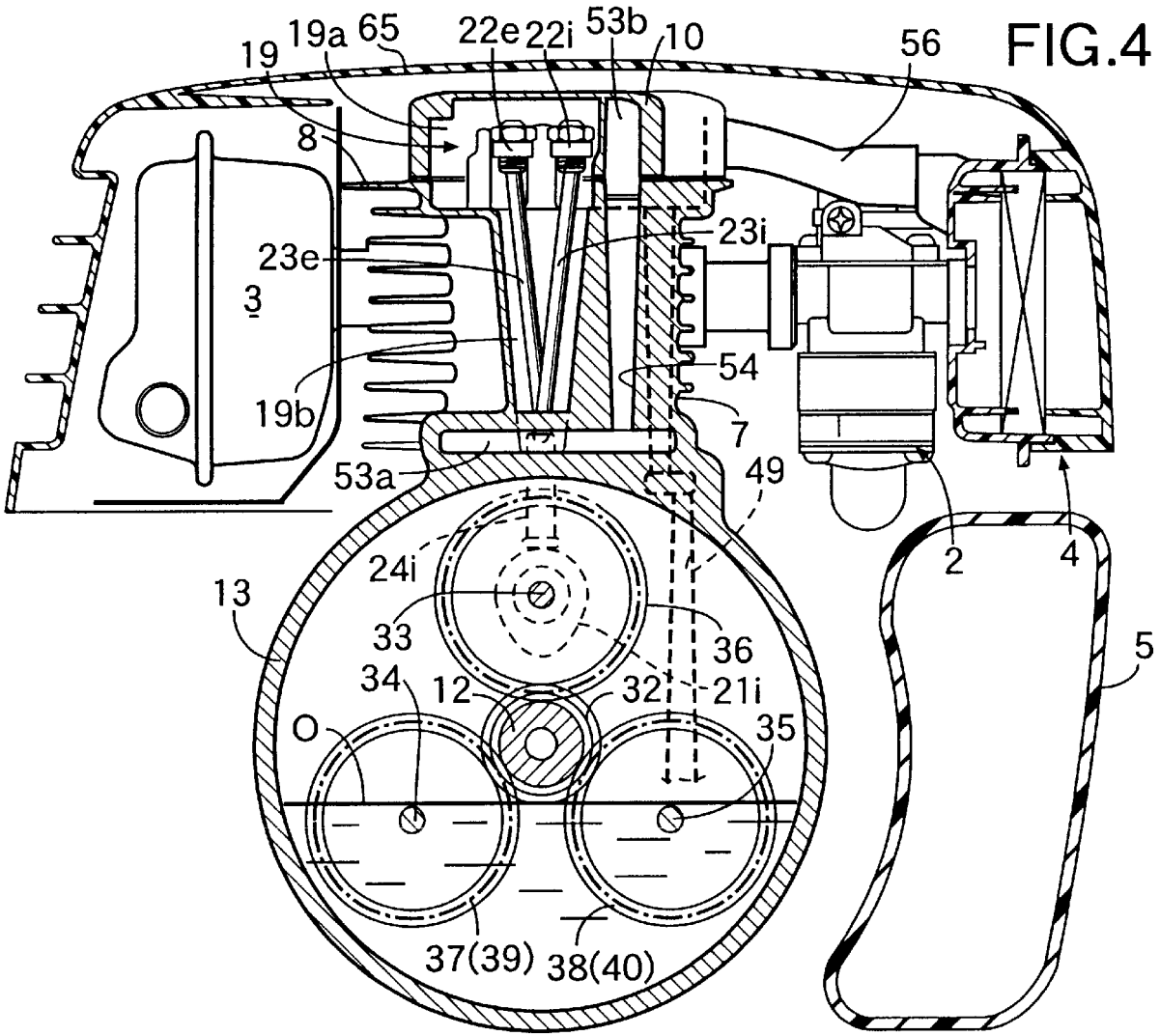

As shown in FIG. 4, the above-mentioned cam gear 36 and the two toothed oil slingers 37 and 38 are positioned with equal intervals therebetween around the crankshaft 12. The peripheral wall of the oil tank 13 is formed in a circular shape so as to surround these gears 36 to 38, a predetermined amount of lubricating oil O is stored inside the oil tank 13, at least one of the cam gear 36, the toothed oil slingers 37 and 38 and the vane type oil slingers 39 and 40 around the drive gear 32 is partially immersed in the stored oil O regardless of the operational position of the engine E, and its rotation scatters the stored oil O so generating an oil mist. The cam gear 36 therefore also functions as part of the oil slingers around the drive gear 32.

The route taken by the oil mist generated in the oil tank 13 includes an oil inlet 45 provided in the crankshaft 12 and providing communication between the oil tank 13 and the crank chamber 6*a*, a valve hole 47 provided in the base of the crank case 6, a valve chamber 48 formed in the lower part of the crankcase 6 and communicated with the crank chamber 6*a* via the above-mentioned valve hole 47, an oil feed passage 49 rising from one side of the valve chamber 48 and extending to the rocker chamber 19*a* through a side wall of the engine main body 1, the rocker chamber 19*a*, the pushrod chamber 19*b*, and an oil return passage 50 extending from the pushrod chamber 19*b* to the oil tank 13 through the outside wall of the oil tank 13. Open ends 45*a* and 50*a* of the above-mentioned oil inlet 45 and the oil return passage 50 inside the oil tank 13 are positioned so as to be always above the liquid level of the stored oil O regardless of the operational position of the engine E.

The above-mentioned valve chamber 48 includes a one-way valve 51 in the form of a reed valve for blocking and unblocking the valve hole 47, and the one-way valve 51 opens so as to unblock the valve hole 47 when the pressure of the crank chamber 6*a* becomes positive and closes so as to block the valve hole 47 when the pressure becomes negative accompanying the descent and ascent respectively of the piston 15.

In FIGS. 3 and 4, a flat-shaped first breather chamber 53*a* forming the middle part of the oil return passage 50 is formed in the partition wall 42 between the valve operation chamber 19 and the oil tank 13, and the first breather chamber 53*a* is connected to a second breather chamber 53*b* via a link passage 54, the second breather chamber 53*b* being formed in the above-mentioned head cover 10. The second breather chamber 53*b* is communicated with the above-mentioned air cleaner 4 on one side via a first orifice 55*a* and a breather pipe 56, and with the rocker chamber 19*a* on the other side via a plurality of second orifices 55*b* which open at different positions and are in different directions from each other.

The action of this embodiment is explained below.

When the drive gear 32 rotates together with the crankshaft 12 during operation of the engine E, the valve operation mechanism 25 is operated as mentioned above, and at the same time, the cam gear 36, the toothed oil slingers 37 and 38, and the vane type oil slingers 39 and 40 all supported by the three support shafts 33, 34 and 35 rotate simultaneously. Since at least one of the cam gear 36, the toothed oil slingers 37 and 38, and the vane type oil slingers 39 and 40 scatters the stored oil O so generating an oil mist regardless of the operational position of the engine E, the oil tank 13 can always be filled with the oil mist. Since the rotational movement section 25*a* of the valve operation mechanism 25 is provided in such an oil tank 13, the rotational movement section 25*a* can be lubricated with the above-mentioned oil mist particularly well.

A negative pressure and a positive pressure are generated alternately in the crank chamber 6*a* accompanying the ascent and descent of the piston 15 so causing pressure pulsations; when a negative pressure is generated, the one-way valve 51 closes so as to block the valve hole 47, and the oil mist inside the oil tank 13 is drawn up into the crank chamber 6*a* through the oil inlet 45 of the crankshaft 12 thus lubricating the crankshaft 12 and the piston 15. At this stage, the internal pressure of the oil tank 13 is reduced due to the oil mist drawn up into the crank chamber 6*a*.

When a positive pressure is generated, since the one-way valve 51 opens so as to unblock the valve hole 47, the oil mist inside the crank chamber 6*a* is discharged together with the blowby gas generated in the crank chamber 6*a* into the rocker chamber 19*a* through the valve hole 47, the valve chamber 48 and the oil feed passage 49, so that the oil mist is spread over the entire valve operation chamber 19, and the reciprocating movement section 25*b* of the valve operation mechanism 25 can thus be lubricated. The oil mist is then liquefied.

The oil liquefied inside the valve operation chamber 19 is transferred to the first breather chamber 53*a* from the upstream section of the oil return passage 50 together with the blowby gas, they are separated into gas and liquid in the first breather chamber 53*a*, the oil portion is returned into the oil tank 13 which is at a lower pressure via the downstream section of the oil return passage 50, and the blowby gas ascends inside the link passage 54 to enter the second breather chamber 53*b*, and is discharged into the air cleaner 4 via the second orifice 55*b* and the breather pipe 56.

In the case where the blowby gas entering the second breather chamber 53*b* contains oil, the oil is separated from the blowby gas in the second breather chamber 53*b*, and flows down through the link passage 54 or enters the valve operation chamber 19 via the second orifice 55*b*.

Since the second breather chamber 53*b* is connected to the breather pipe 56 via the first orifice 55*a*, the first orifice 55*a* can minimise as much as possible the leakage of negative pressure of the oil tank 13 from the second breather chamber 53*b* towards the breather pipe 56, and thus the oil tank 13 can always maintain its internal negative pressure rendered by the pressure pulsations of the crank chamber 6*a* during operation of the engine E.

The oil mist can thus be circulated from the oil tank 13 to the crank chamber 6*a*, the valve operation chamber 19, and back to the oil tank 13 by utilising the pressure pulsations of the crank chamber 6*a*, the inside of the engine E can be lubricated regardless of the operational position of the engine E, and it is unnecessary to employ a special oil pump. In particular, since the rotational movement section 25*a* requiring a high level lubrication of the valve operation mechanism 25 is lubricated with a large amount of oil mist generated in the oil tank 13, the rotational movement section 25*a* can be lubricated well as required.

Since the oil tank 13 is provided so as to be connected to one side wall running the length of the crankcase 6 and the cylinder block 7, it is unnecessary to provide an oil reservoir in the lower part of the crankcase 6, and the overall height of the engine E can be lessened and the size thereof can be reduced.

The second and third embodiments of the present invention are explained below by reference to FIGS. 5 and 6.

The second and third embodiments are different from the first embodiment in terms of the arrangement of the toothed oil slingers 37 and 38 around the drive gear 32, the shape of the peripheral wall of the oil tank 13, and the shape and arrangement of the fuel tank 5.

That is to say, in the second embodiment shown in FIG. 5, the two toothed oil slingers 37 and 38 are placed immediately beside and immediately below the drive gear 32 respectively, and the peripheral wall of the oil tank 13 is generally made in the form of a D-shape around the oil slingers 37 and 38 and the cam gear 36, immediately above the drive gear 33. Since there is a comparatively large space outside the vertical wall 13*w* of the oil tank 13 so formed, a fuel tank 5 having a large capacity can be placed in this space.

Figure 6:
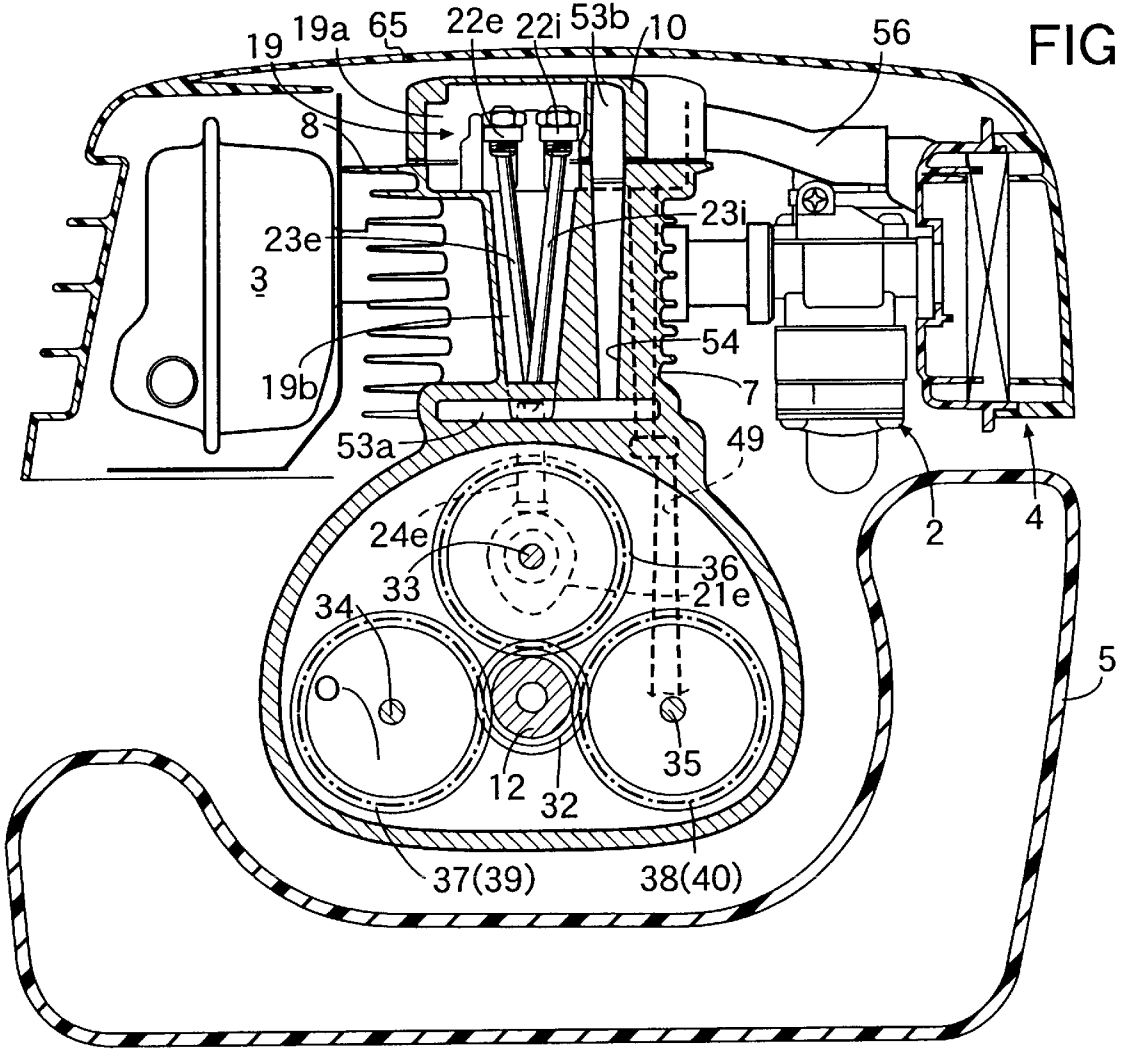
FIG. 6 is a cross-sectional view corresponding to FIG. 4 and illustrating a third embodiment of the present invention.

In the third embodiment shown in FIG. 6, the two toothed oil slingers 37 and 38 are placed on either side of the drive gear 32 so as to be close to the cam gear 36 placed above the two oil slingers 37 and 38, and the peripheral wall of the oil tank 13 is made in the form of a rounded triangle around the cam gear 36 and the oil slingers 37 and 38. The oil tank 13 so formed has a shallow base, and since there is a flat space below the oil tank 13, an L-shaped fuel tank 5 having a large capacity can be disposed from one side to the base of the oil tank 13.

Figure 5:
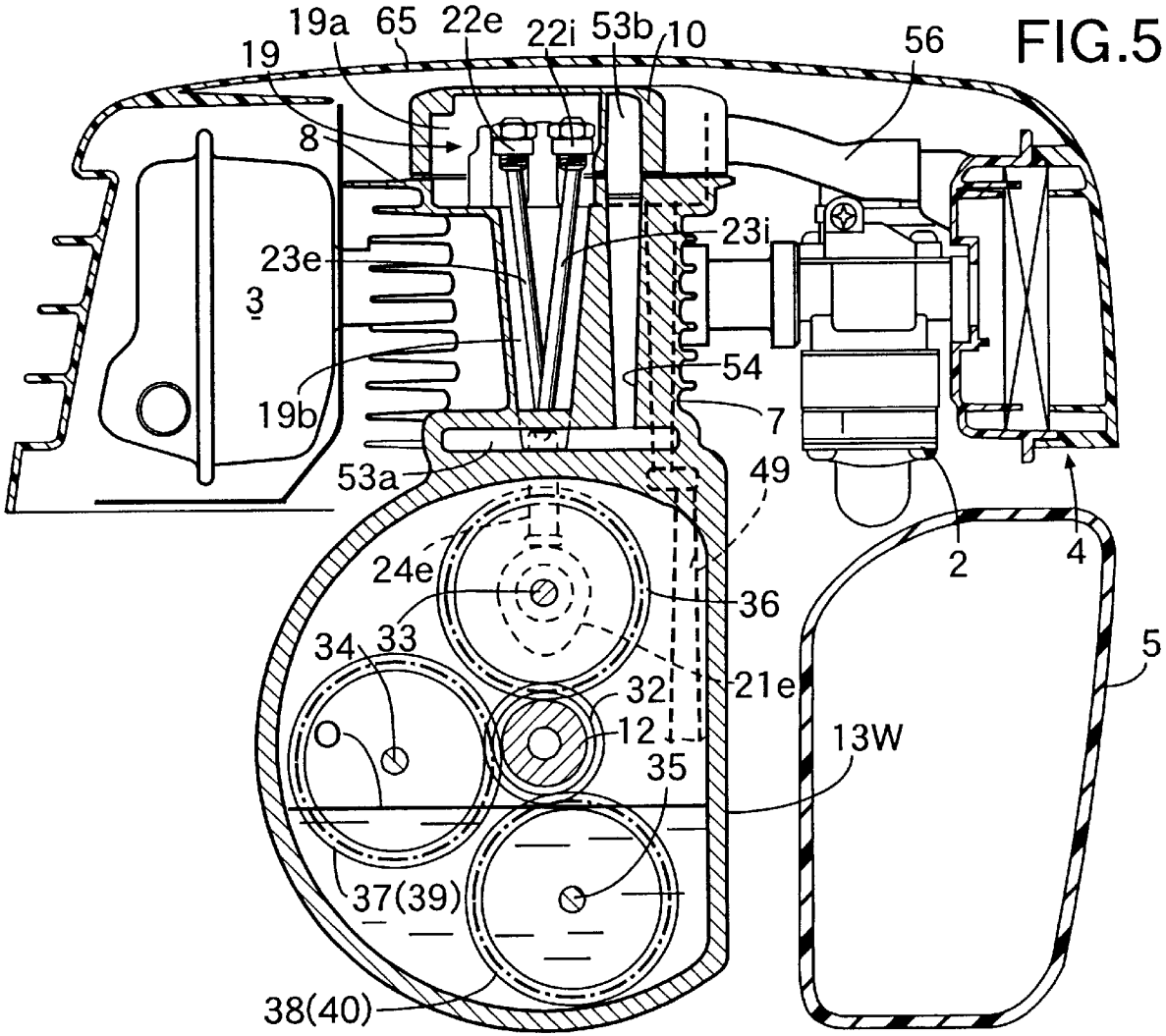
FIG. 5 is a cross-sectional view corresponding to FIG. 4 and illustrating a second embodiment of the present invention.

The components in FIGS. 5 and 6 corresponding to those in the first embodiment are denoted by the same reference numerals and are not explained.

As is clear from the above-mentioned first to third embodiments, by selecting the positions of the support shafts 33, 34 and 35 placed around the drive gear 32, that is to say, the positions of the cam gear 36 and the toothed oil slingers 37 and 38, the shape of the peripheral wall of the oil tank 13 surrounding them can be changed freely, and the degree of freedom in the layout of equipment adjoining the oil tank 13 increase.

Moreover, since the cam gear 36 and the toothed oil slingers 37 and 38 are simultaneously driven by the drive gear 32 in such a state that they are close to the peripheral wall of the oil tank 13, the stored oil O can be scattered by at least one of the cam gear 36 and the toothed oil slingers 37 and 38 regardless of the operational position of the engine E so always generating an oil mist reliably.

Since the cam gear 36 functions as part of the oil slingers provided around the driven gear 32, the number of special oil slingers can be reduced and the structure can thus be simplified.

Figure 7:
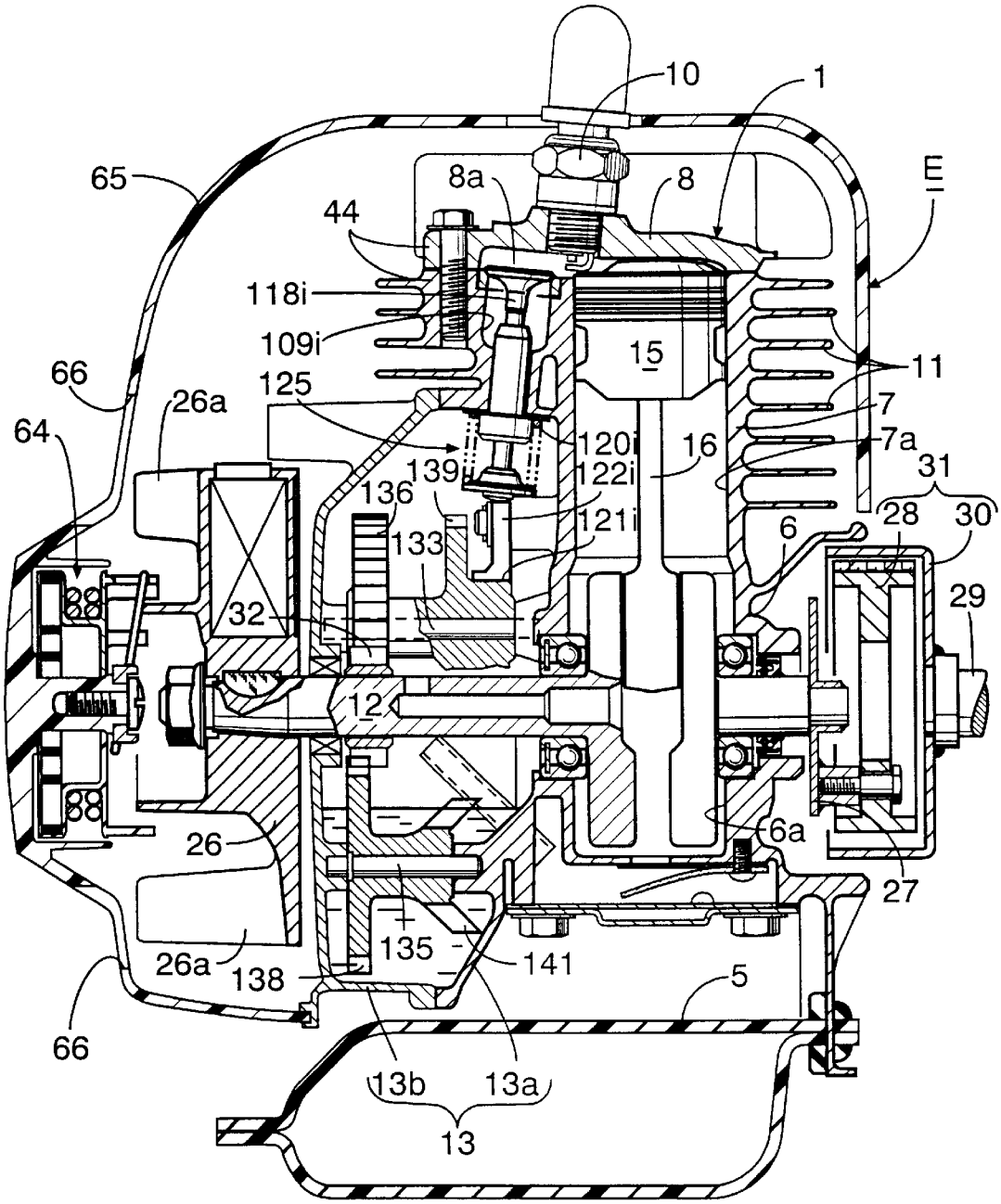
FIG. 7 is a vertically sectioned front view of a side-valve type engine illustrating a fourth embodiment of the present invention.
Figure 8:
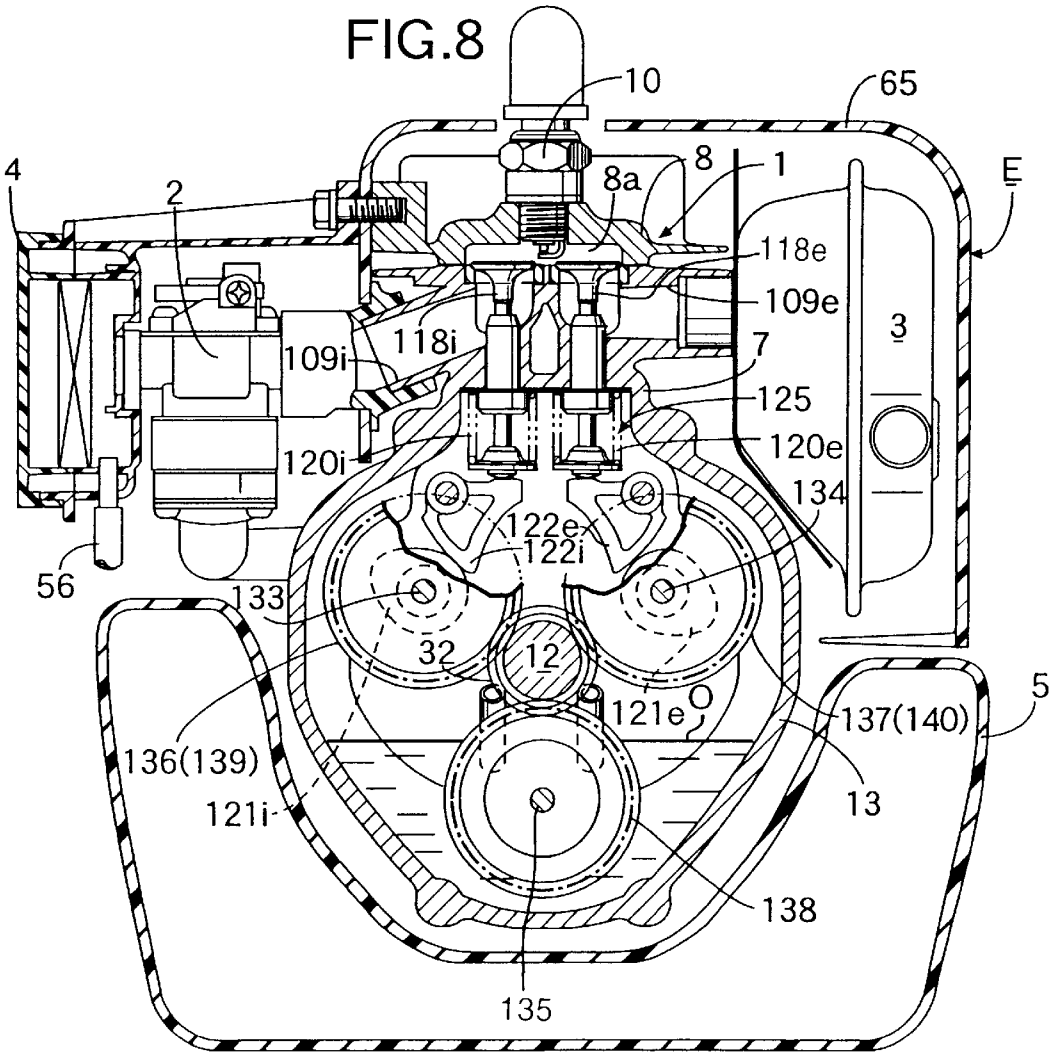
FIG. 8 is a cross-sectional view at line 8—8 in FIG. 7.

Lastly, a fourth embodiment of the present invention is explained by reference to FIGS. 7 and 8.

The main difference between the fourth embodiment and each of the above-mentioned embodiments is that the fourth embodiment particularly includes an engine E which is of the side-valve type. That is to say, the cylinder block 7 and the cylinder head 8 have an overhang section 44 which overhangs on the side of the oil tank 13, and the lower part of the overhang section 44 forms part of the upper wall of the oil tank 13. The combustion chamber 8*a* is formed in the part of the cylinder head 8 corresponding to this overhang section 44, and an intake port 109*i* and an exhaust port 109*e* communicated with the combustion chamber 8*a* are formed in the cylinder block 7.

An intake valve 118*i* and an exhaust valve 118*e* are mounted in the overhang 44, that is, the upper wall of the oil tank inner half 13*a*, in a ascendable-descendable manner so that their valve heads project into the oil tank 13, the intake valve 118*i* and the exhaust valve 118*e* opening and closing the intake port 109*i* and the exhaust port 109*e* respectively. A valve operation mechanism 125 for operating the intake valve 118*i* and the exhaust valve 118*e* so as to open and close them is placed inside the oil tank 13.

This valve operation mechanism 125 includes the drive gear 32 fixed to the crankshaft 12, a pair of cam gears 136 and 137 rotatably supported on a pair of support shafts 133 and 134 provided in the oil tank 13 above the crankshaft 12, the cam gears 136 and 137 being driven by the drive gear 32 at a reduction rate of ½, an intake cam 121*i* and an exhaust cam 121*e* formed integrally with the cam gears 136 and 137 respectively, an intake cam follower 122*i* and provided between the intake cam 121*i* and the intake valve 118*i*, an exhaust cam follower 122*e* pivotally supported in the oil tank 13 in a rockable manner and provided between the exhaust cam 121*e* and the exhaust valve 118*e*, and valve springs 120*i* and 120*e* forcing the intake valve 118*i* and the exhaust valve 118*e* respectively in the closed direction. The engine E is thus arranged as a side-valve type.

The cam gear 136 and the intake cam 121*i*, and also the cam gear 137 and the exhaust cam 121*e* are placed at a large distance from each other in the axial direction so that they closely adjoin the left and right side walls respectively of the oil tank 13. Toothed oil slingers 139 and 140 are formed integrally with the intake cam 121*i* and the exhaust cam 121*e* respectively so as to adjoin them.

A support shaft 135 is also provided in the oil tank 13 at a position beneath the crankshaft 12, and this support shaft 135 supports a toothed oil slinger 138 and a vane type oil slinger 141 in a rotatable manner, the toothed oil slinger 138 being driven by the drive gear 32 and the oil slinger 141 being integrated with the toothed oil slinger 138. The toothed oil slinger 138 and the vane-type oil slinger 141 are positioned at a distance from each other in the axial direction so that they closely adjoin the left and right inner walls respectively of the oil tank 13.

A predetermined amount of lubricating oil O is stored in the oil tank 13, at least one of the cam gears 136 and 137 and the oil slingers 138 to 141 is partially immersed in the stored oil O regardless of the operational position of the engine E, and the stored oil O is scattered by the rotation thereof so generating an oil mist. The cam gears 136 and 137 therefore function as part of the oil slingers around the drive gear 32.

What is claimed is:

1. An oil mist generation system in a handheld type four-cycle engine including an oil slinger which is provided in an oil tank disposed on one side of an engine main body and which is rotated by a crankshaft, the oil slinger scattering oil stored in the oil tank by the rotation of the oil slinger so as to generate an oil mist, wherein a drive gear provided on the gear shaft; and at least three oil slingers supported on three support shafts and simultaneously driven by the drive gear, the three support shafts being arranged around the drive gear such that said three oil slingers are accommodated within said oil tank, wherein a rotating member of a valve operation mechanism functions as part of the oil slingers, wherein said oil tank is formed continuously with a side wall of said engine main body and said crankshaft projects from said side wall to extend across the oil tank, and wherein any of said three slingers is partially immersed in the oil of the oil tank regardless of an operational position of the engine.

* * * * *